US009818393B2

(12) United States Patent
Lagarrigue et al.

(10) Patent No.: US 9,818,393 B2
(45) Date of Patent: Nov. 14, 2017

(54) ACOUSTICALLY ABSORBENT CELL FOR ACOUSTIC PANEL

(71) Applicants: CENTRE NATIONAL DE LA RECHERCHE SCIENTIFIQUE, Paris (FR); UNIVERSITE DU MAINE, Le Mans (FR); SUPMECA, Saint Ouen (FR)

(72) Inventors: Clement Lagarrigue, Le Mans (FR); Jean-Philippe Groby, Le Mans (FR); Vincent Tournat, Beaufay (FR); Olivier Dazel, Le Mans (FR); Benoit Nennig, Paris (FR)

(73) Assignees: LE CENTRE NATIONAL DE LA RECHERCHE SCIENTIFIQUE, Paris (FR); UNIVERSITE DU MAINE, Le Mans (FR); SUPMECA, Saint Ouen (FR)

( * ) Notice: Subject to any disclaimer, the term of this patent is extended or adjusted under 35 U.S.C. 154(b) by 0 days.

(21) Appl. No.: 14/915,486

(22) PCT Filed: Aug. 29, 2014

(86) PCT No.: PCT/FR2014/052149
§ 371 (c)(1),
(2) Date: Feb. 29, 2016

(87) PCT Pub. No.: WO2015/028760
PCT Pub. Date: Mar. 5, 2015

(65) Prior Publication Data

US 2016/0210955 A1 Jul. 21, 2016

(30) Foreign Application Priority Data

Aug. 29, 2013 (FR) ..... 13 58261

(51) Int. Cl.
*G10K 11/172* (2006.01)
*G10K 11/16* (2006.01)

(52) U.S. Cl.
CPC ..... *G10K 11/172* (2013.01)

(58) Field of Classification Search
CPC ..... G10K 11/172; G10K 11/16
(Continued)

(56) References Cited

U.S. PATENT DOCUMENTS 2,390,262 A * 12/1945 Mazer ..... E04B 1/82 181/295
3,275,101 A * 9/1966 Davis, Jr. ..... E04B 1/86 181/285
(Continued)

FOREIGN PATENT DOCUMENTS

DE 94 08 118 U1 9/1995
DE 195 39 309 A1 4/1997
(Continued)

OTHER PUBLICATIONS

Groby et al., "Enhancing the absorption coefficient of a backed rigid frame porous layer by embedding circular periodic inclusions", The Journal of the Acoustical Society of America, Dec. 2011, vol. 130, No. 6, pp. 3771-3780.
(Continued)

*Primary Examiner* — Edgardo San Martin
(74) *Attorney, Agent, or Firm* — Westerman, Hattori, Daniels & Adrian, LLP

(57) ABSTRACT

An acoustically absorbent cell for an acoustic panel, comprising a layer with a porous matrix incorporating a plurality of acoustic resonators between a first face and a second face of the porous matrix is described. The resonators are ordered
(Continued)

so as to form at least two substantially parallel rows each comprising at least two resonators and extending along the first and second faces.

18 Claims, 6 Drawing Sheets

(58) Field of Classification Search
USPC ..... 181/288, 284, 290, 293, 295, 210
See application file for complete search history.

(56) References Cited

U.S. PATENT DOCUMENTS 4,319,661 A * 3/1982 Proudfoot ..... G10K 11/172 181/286
5,220,535 A * 6/1993 Brigham ..... B63G 8/39 367/1
5,422,446 A * 6/1995 Fries ..... G10K 11/172 181/293
5,457,291 A * 10/1995 Richardson ..... B28B 23/0068 181/293
5,777,947 A 7/1998 Ahuja
5,854,453 A * 12/1998 Fujiwara ..... E01F 8/0058 181/286
5,905,234 A * 5/1999 Tsukamoto ..... G10K 11/172 181/286
5,959,265 A * 9/1999 Van Ligten ..... G10K 11/172 181/286
6,021,612 A * 2/2000 Dunn ..... E01F 8/007 181/286
6,167,985 B1 * 1/2001 Van Ligten ..... G10K 11/172 181/286
6,568,135 B1 * 5/2003 Yokoyama ..... E01F 8/0094 181/208
8,132,644 B2 * 3/2012 Van Veen ..... G10K 11/168 181/210
8,789,651 B2 * 7/2014 Kawai ..... G10K 11/168 181/284
8,789,652 B2 * 7/2014 Swallowe ..... G10K 11/172 181/293
9,343,059 B2 * 5/2016 Wilson ..... G10K 11/172
2012/0247867 A1 * 10/2012 Yang ..... E04B 1/86 181/211
2012/0273295 A1 * 11/2012 Kolaini ..... G10K 11/172 181/198
2013/0118831 A1 * 5/2013 Kawai ..... G10K 11/168 181/290
2016/0203812 A1 * 7/2016 Wilson ..... G10K 11/172 181/293

FOREIGN PATENT DOCUMENTS

EP 0 926 656 A1 6/1999
EP 0 965 977 A2 12/1999
EP 2 595 142 A1 5/2013
GB 2 027 255 A 2/1980
JP 01226907 A * 9/1989
WO 85/02640 A1 6/1985
WO 2011/048323 A2 4/2011

OTHER PUBLICATIONS

Groby et al., "Absorption of a rigid frame porous layer with periodic circular inclusions backed by a periodic grating", The Journal of the Acoustical Society of America, May 2011, vol. 129, No. 5, pp. 3035-3046.
International Search Report dated Nov. 27, 2014, issued in counterpart PCT Application No. PCT/FR2014/052149 (3 pages).

* cited by examiner

Prior Art

ACOUSTICALLY ABSORBENT CELL FOR ACOUSTIC PANEL

The present invention relates to an absorbent acoustic cell as well as an absorbent acoustic panel comprising a plurality of cells.

BACKGROUND OF THE INVENTION

At the present time, the materials used for acoustic absorption are mainly materials with a porous matrix such as so-called porous materials (polyurethane foam, etc.) or so-called fibrous materials (glass wool, palm fibre, etc.). It is easy to integrate these materials into acoustic panels. In addition, the panel thus obtained is lightweight and has good acoustic attenuation in a major part of the frequencies of the audible spectrum.

However, these materials do not afford good attenuation in very low frequency sounds, that is to say for frequencies of around 50 Hz to 1000 Hz with thin panels with a thickness of around 5 to 10 cm, corresponding for example to the noise emitted by an engine ticking over. This is particularly true for frequencies where the corresponding wavelength is greater than four times the thickness of the material.

To overcome this problem, the solution commonly adopted consists of increasing the thickness and mass of the porous matrix by combining layers of different porous materials. The main drawback lies in greater size and mass of the acoustic panel.

Studies, in particular that of Groby et al. "*Enhancing the absorption coefficient of a backed rigid frame porous layer by embedding circular periodic inclusions*" (JASA, 130(6): 3771, 2011), have shown that the use of resonators such as split rings or Helmholtz resonators arranged in a layer of porous material made it possible to significantly absorb the low-frequency sounds incident on such a structure.

These structures thus significantly increase acoustic absorption. The physical phenomena have been revealed in several scientific publications, such as the article by Allard and Atalla "*Propagation of sound in porous media: modelling sound absorbing materials*" (Chapter 5, page 85, Wiley, 2009) with regard to the acoustic behaviour of a porous material, and in the scientific article by Groby et al. cited above with regard to the behaviour of the resonators included in the porous matrix.

Thus these structures make it possible to attenuate the acoustic energy through viscous and thermal losses. The resonators integrated in the porous matrix act as diffusers, reflecting the incident acoustic wave in all directions. Some of the acoustic energy is also absorbed because of the resonance of the resonators at their resonant frequency that depends on the dimensional characteristics of the resonator.

However, at the present time, though the efficacy of such a cell had been demonstrated, no particular industrially applicable geometry has yet been proposed. This is because the aforementioned studies were limited to demonstrating the advantage of a porous-matrix cell integrating a resonator. In addition, though the coefficient of absorption with such a cell is greater over the entire range of low frequencies up to 6000 Hz, it is greater than 0.8 only for frequencies above 2500 Hz and is less than 0.5 for very low frequencies below 1700 Hz.

In the scientific publications "*Absorption of a rigid frame porous layer with periodic inclusions backed by a periodic grating*", JASA, 129(5), May 2011, and "*Enhancing the absorption coefficient of a backed rigid frame porous layer by embedding circular periodic inclusions*", JASA, 130(6), December 2011, Groby et al. propose a numerical model comprising a layer of porous material comprising infinitely rigid cylinders, the arrangement of which makes it possible to form a diffraction grating. The cylinders used in the numerical model are cylinders defined numerically as infinitely rigid so that they cannot be assimilated to acoustic resonators.

BRIEF SUMMARY OF THE INVENTION

The aim of the invention is in particular to afford a simple, effective and economical solution to these problems.

To this end, it proposes an acoustically absorbent cell for an acoustic panel, comprising a layer with a porous matrix incorporating a plurality of acoustic resonators between a first face and a second face of the porous matrix, characterised in that the resonators are ordered so that, in a direction extending substantially perpendicular to the first face and the second face, at least one first resonator is arranged between the first face and at least one second resonator is arranged between the second face and the at least one first resonator.

The invention thus proposes a particular arrangement of acoustic resonators inside a porous matrix. Integrating in the cell at least two resonators arranged one behind the other in a direction perpendicular to the first and second faces of the cell makes it possible to achieve very good absorption of low-frequency sounds both by absorption of the acoustic waves at the resonant frequencies of the resonators and by diffusion of the incident acoustic waves in all directions on the external surface of each resonator because of the use of two rows of resonators increasing the degree of reflection and therefore the coefficient of absorption of the cell.

Preferentially, the porous material is of the so-called open pore type, that is to say, when the material is filled with air, the air can circulate between the pores.

According to another feature of the invention, the dimensional parameters of the resonators are determined so that the resonators are all different in pairs.

The integration in a cell of a plurality of resonators all different in pairs through their dimensional parameters makes it possible to ensure absorption of each resonator at a different resonant frequency. It is desirable for these various resonant frequencies to be sufficiently close to one another in order to have a sufficiently great partial overlap of the frequency bands each associated with a resonance peak of a resonator so as to maintain the coefficient of absorption of the cell sufficiently high over a wide range of frequencies. This is achieved by choosing the dimensions of the resonators in a suitable manner.

Preferentially, the distances separating two resonators are all different in pairs. This particular arrangement of the resonators makes it possible to increase the destructive interferences between two given resonators, which increases the coefficient of absorption of the cell.

According to another feature of the invention, the first face comprises a layer of a rigid material having for example a Young's modulus of at least 20 GPa.

The layer of rigid material forms a wall of the cell beyond which the incident acoustic waves are not transmitted. This rigid layer may serve for attachment to a support intended for fixing the cell to an acoustic panel. The thickness of the layer is determined so that the incident acoustic waves can be reflected on this layer.

Advantageously, the first face is conformed so as to comprise at least one indentation forming a cavity extending in a direction opposite to the second face and emerging between the first and second faces.

Adding cavities on one of the faces of the cell makes it possible to absorb sounds at low frequencies that are determined by the thickness, that is to say the dimension of the cavities in a direction transverse to the first face and the second face. The resonant wavelength of each cavity corresponds to one quarter of the depth of each cavity.

In practice, in order to avoid excessively increasing the total thickness of an acoustic panel comprising a plurality of cells according to the invention arranged side by side, it is desirable for the cavities each to have a thickness of between 5 mm and 20 mm. Thus the thicknesses of the cavities are determined so that the quarter-wave resonant frequencies are between the frequencies of the resonators, the dimensions of which are determined so as to be between 500 and 1500 Hz and the frequencies of absorption of the porous matrix between 2500 and 6000 Hz.

It should be noted that, with cavities, the best absorption results are obtained with two resonators exactly arranged one behind the other in the direction perpendicular to the first and second faces. This is because the use of three layers or thicknesses of resonators with cavities does not allow the acoustic waves to reach the cavities because of the multiple reflections on the external surfaces of the resonators, acting on the path of the acoustic waves. Reducing the diameter of the resonators, in order to reduce the reflections and to allow a greater quantity of acoustic waves to reach the cavities, is not desirable since this would involve an increase in the resonant frequencies of the resonators.

According to another feature of the invention, the second face is substantially planar and the cavity or cavities have a rectangular or square cross-section.

In a practical embodiment of the invention, the resonators each comprise at least one opening making a resonant cavity of the resonator communicate with the porous matrix surrounding the resonator. The opening of at least one of said at least one first resonator emerges in the opening of a cavity on the first face.

This particular arrangement, that is to say the assembly formed from said resonator the opening of which emerges in the direction of the cavity, makes it possible to create an interaction between the resonator and the cavity. This is because simulations have shown that the assembly formed by the resonator and the cavity behaved as a resonator at a lower frequency than each of the respective frequencies of the resonator and cavity, which makes it possible to absorb lower frequencies without having to use a more bulky resonator, which would require increasing the thickness of the layer of the porous matrix, that is to say the distance between the first and second faces of the cell.

Preferentially, the resonators each have an elongate shape in a given direction extending along the first and second faces of the cell.

The directions of elongation of the resonators are preferentially substantially parallel to one another.

The resonators may be chosen from one or more of the types of resonator in the group comprising split tubes open at their ends and with a square, rectangular, circular, ellipsoidal or star-shaped cross-section, or Helmholtz resonators comprising at least one tubular neck emerging inside a cavity of the resonator.

In a possible embodiment of the cell according to the invention, the resonators are all of the same type.

In a practical embodiment of the invention, the resonators are all tubes with a circular cross-section, split over their entire height.

The cell may comprise two first resonators forming a first row arranged between the first face and at least two second resonators forming a second row that is arranged between the first row of first resonators and the second face.

According to the invention, the first row and second row may each comprise at least three resonators.

The invention further relates to an acoustically absorbent panel, characterised in that it comprises a plurality of cells as described above, the cells being arranged alongside one another so that the edges of the first faces of the cells are arranged opposite and the edges of the second faces of the cells are arranged opposite.

The panel may comprise five cells and preferentially ten.

BRIEF DESCRIPTION OF THE DRAWINGS

The invention will be better understood and other details, advantages and features of the invention will emerge from a reading of the following description given by way of non-limitative example, with reference to the accompanying drawings, in which.

DETAILED DESCRIPTION OF THE INVENTION

Figure 1:
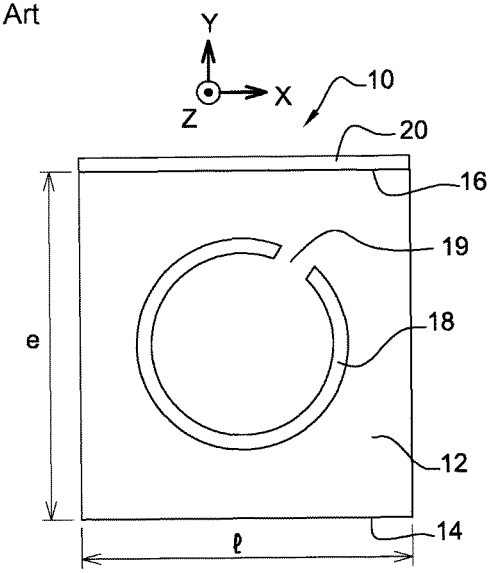
Fig. 1 Prior Art
FIG. 1 is a schematic view in cross-section of an acoustically absorbent cell according to the known art.

Reference is made first of all to FIG. 1, which depicts an acoustically absorbent cell 10 according to the prior art, comprising a layer 12 formed by a matrix of a porous material comprising first 14 and second 16 faces facing each other and between which an acoustic resonator 18 is arranged. The dimensions of the cell 10 are defined in the three perpendicular directions in space, in the direction X by its width 1, in the direction Y by its thickness e and in the direction Z by its length L.

Figure 2:
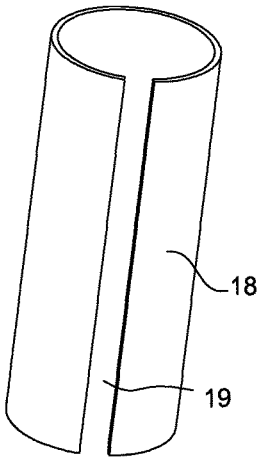
FIG. 2 is a schematic perspective view of the resonator of the cell of FIG. 1.

In the cell 10 in FIG. 1 and as depicted in FIG. 2, the acoustic resonator 18 is formed by a tube with a circular cross-section open at its two opposite ends and comprising a slot 19 extending over the entire length of the tube. The resonator 10 therefore has a shape elongate in a direction of axis Z, the resonator 10 being arranged between the first 14 and second 16 faces so that the axis Z extends along the first 14 and second 16 faces. The first face 14 is covered with a layer 20 of a material more rigid than the porous matrix. In practice, it is desirable for the Young's modulus of the layer 20 to be at least 20 GPa. This rigid layer 20 may be made from brass or aluminium, or even wood for example. The porous matrix has a Young's modulus of around few thousands of kPa, which makes it possible to provide a sufficiently great difference in impedance between the matrix and the rigid layer so as to guarantee total reflection at the acoustic waves of the interface.

It should be noted that, in the case of vibrations of the first face according to plate modes, it is possible to add a metal plate to the first face in order to limit these vibrations.

As indicated previously, though this type of cell 10 greatly increases the coefficient of absorption, this is not yet sufficiently close to unity.

To this end, the invention thus proposes an acoustically absorbent cell in which the resonators are ordered in a direction extending substantially perpendicular to the first face and the second face so that at least one first resonator is arranged between the first face and at least one second resonator is arranged between the second face and the at least one first resonator.

Figure 3:
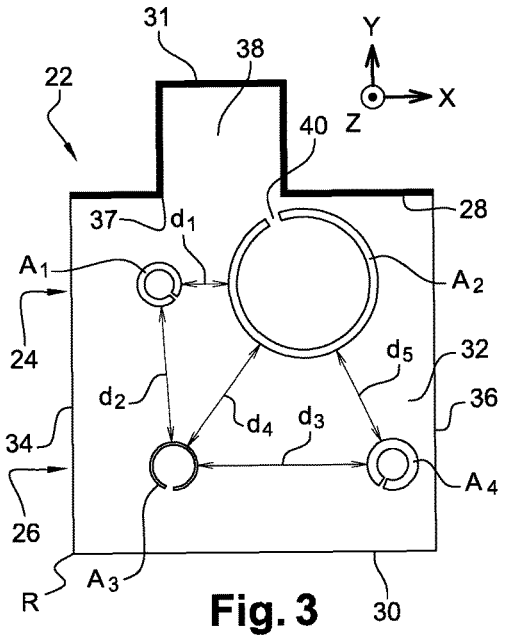
FIG. 3 is a schematic view in cross-section of an acoustic absorbent cell according to a first embodiment of the invention.

Thus, in a first embodiment depicted in FIG. 3, the cell 22 comprises first 24 and second 26 rows of acoustic resonators between the first 28 and second 30 faces of a layer 32 with a porous matrix. The cell 22 comprises two opposite lateral faces 34, 36 substantially parallel and perpendicular to the first face 28 and second face 30. The first row 24 is arranged, in a direction perpendicular to the first 28 and second 30 faces of the cell 22, between the first face 28 and the second row 26 of resonators, this second row 26 being arranged between the first row 24 and the second face 30 of the cell 22.

In this first embodiment, each of the first and second rows 24, 26 comprises two acoustic resonators $A_1$, $A_2$ and $A_3$, $A_4$, respectively. The resonators $A_1$, $A_2$ and $A_3$, $A_4$ used in this embodiment are split tubes as described above. The tubes $A_1$, $A_2$, $A_3$, $A_4$ thus each have an elongate shape in a direction Z extending along the first 28 and second 30 faces. The axes Z of the tubes are substantially parallel to one another in the cell 22. The first face 30 is also covered with a rigid layer as described with reference to FIG. 1.

As depicted, the resonators $A_1$, $A_2$, $A_3$, $A_4$ have dimensional parameters such that the resonators are all different in pairs. The dimensional parameters in question are the thickness of the wall of the tube and the external radius mainly. The angular opening of the slot in each ring also influences, but to a lesser extent, the resonant frequency of the resonators. By increasing the angular opening, it is possible to slightly decrease the resonant frequency. However, the larger the angular opening the greater the intensity of the resonance.

As observed in FIG. 3, the distances d1-d5 separating two resonators $A_1$, $A_2$, $A_3$, $A_4$ are all different in pairs so as to increase the destructive interferences between two given resonators $A_1$, $A_2$, $A_3$, $A_4$, increasing the coefficient of absorption of the cell accordingly.

The first face 30 of the cell is conformed so as to comprise an indentation delimiting a cavity 38 extending in a direction opposite to the second face 28 and emerging between the two first 28 and second 30 faces. As depicted in FIG. 3, the split tube $A_2$ in the row 24 of resonators adjacent to the first face is situated in the immediate vicinity of the cavity 38 and its opening or slot 40 emerges in the direction of the outlet of the cavity 38. This particular arrangement ensures that the assembly formed by the resonator $A_2$ and the cavity 38 behaves as a resonator functioning at a frequency lower than the resonant frequency of the cavity 38 and of the resonator $A_2$.

The cavity 38 of the first face 30 of the cell 22 extends along the axis Z substantially over the same distance as the split tube $A_2$.

The following table summarises the dimensional parameters of the four resonators $A_1$, $A_2$, $A_3$ and $A_4$ and their respective positionings in the cell. The angle values are measured with respect to the direction opposite to the direction of Y given in FIG. 3. The reference for the positions of the centres of the resonators is taken at R in FIG. 3.

In the following table, the values given for each column (except for the third column) are those of a parameter x (with dimension) that constitutes an input value of an equation given in the boxes of the first line in order to deduce therefrom the quantity in the column of interest.

| | External radius (R = x * E/4) | Thickness of the wall (e = 2R * x) | Angular position of the slot | Width of the slot (L = x * R) | Position along the axis X of the centre of the resonator (Px = x * a) | Position along the axis Y of the centre of the resonator (Py = x * E) |
|---|---|---|---|---|---|---|
| Resonator $A_1$ | 0.1 to 0.3 [0.2] | 0.15 to 0.30 [0.25] | 25° to 70° [30] | 0.1 to 0.4 [0.2] | 0.2 to 0.4 [0.27] | 0.6 to 0.9 [0.75] |
| Resonator $A_2$ | 0.5 to 0.8 [0.75] | 0.05 to 0.1 [0.07] | 190° to 230° [195] | 0.1 to 0.4 [0.2] | 0.6 to 0.8 [0.65] | 0.6 to 0.9 [0.75] |
| Resonator $A_3$ | 0.1 to 0.4 [0.3] | 0.02 to 0.05 [0.03] | −15° to 15° [−10] | 0.1 to 0.4 [0.2] | 0.2 to 0.4 [0.37] | 0.2 to 0.4 [0.25] |
| Resonator $A_4$ | 0.1 to 0.4 [0.3] | 0.15 to 0.30 [0.25] | 310° to 340° [320] | 0.1 to 0.4 [0.2] | 0.7 to 0.9 [0.87] | 0.2 to 0.4 [0.25] |

In each case, the value between brackets indicates a preferred value in the range of values indicated.

"E" represents the thickness of the layer of porous material. "a" represents the width of the cell in the direction X (see FIG. 3).

The following table gives the particular values of the cell depicted in FIG. 3 for the values between brackets in the previous table, the value of "E" being 40 mm and the value of "a" being 40 mm.

| | External radius (mm) | Thickness of the wall (mm) | Angular position of the slot (degrees) | Width of the slot (mm) (L = x * R) | Position along the axis X of the centre of the resonator (mm) | Position along the axis Y of the centre of the resonator (mm) |
|---|---|---|---|---|---|---|
| Resonator $A_1$ | 2 | 1 | 30 | 0.4 | 11 | 30 |
| Resonator $A_2$ | 7.5 | 1 | 195 | 1.5 | 26 | 30 |
| Resonator $A_3$ | 3 | 0.2 | 275 | 0.6 | 15 | 10 |
| Resonator $A_4$ | 3 | 1.5 | 275 | 0.6 | 35 | 10 |

The following table summarises the dimensional parameters of the cavity 38 and the positioning of the corner 37 of the cavity. In the following table, the values given for each column (with the exception of the "position of the corner 37", which gives a value in mm) are those of a parameter x (without dimension) which constitutes an input value of an equation given in each column of interest. The value between brackets in each case indicates a preferred value of a range of values indicated.

| | Position of the corner 37 in X (Px = x * a) | Position of the corner 37 in Y (mm) | Dimension of the cavity along the axis (Dx = x * a) | Dimension of the cavity along the axis (Dy = x * E) |
|---|---|---|---|---|
| Cavity 38 | 0.1 to 0.6 [0.2] | E | 0.1 to 0.4 [0.32] | 0.1 to 0.6 [0.27] |

The following table gives the particular values of the cavity 38 in FIG. 3 for the values between brackets in the previous table, the value of "E" being 40 mm and the value of "a" being 40 mm.

| | Position of the corner 37 in X (mm) | Position of the corner 37 in Y (mm) | Dimension of the cavity along the axis X (mm) | Dimension of the cavity along the axis Y (mm) |
|---|---|---|---|---|
| Cavity 38 | 8 | 40 | 13 | 11 |

Figure 4:
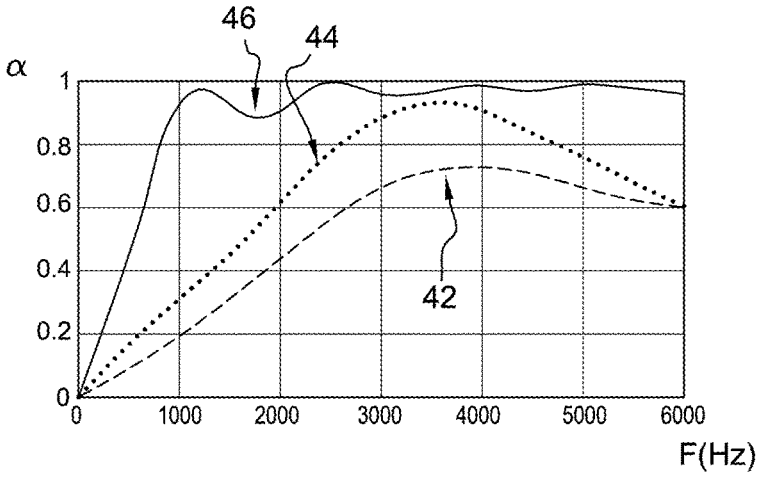
FIG. 4 is a graph showing on the Y axis the coefficient of absorption as a function of the frequency on the X axis for the cell of FIG. 1, the cell of FIG. 3 and the foam alone in which the resonator or resonators are arranged.

FIG. 4 represents the change in absorption a (without unit) on the Y axis as a function of the frequency (in Hz) on the X axis. This graph comprises three curves, a first one 42 which concerns the absorption of a porous matrix alone made from melamine, the second 44 concerns the absorption of the cell in FIG. 1 with a melamine matrix and the third 46 concerns the absorption of the cell according to the invention in FIG. 3, also with a melamine matrix.

It is clear that the coefficient of absorption with the cell in FIG. 1 (curve 44) is greater to the coefficient of absorption obtained with the porous matrix alone (curve 42). In addition, the coefficient of absorption of the curve 44 is greater than 0.8 only in a restricted range of frequencies between 2500 and 3700 Hz. Finally, for frequencies below 1700 Hz, the absorption is below 0.5. Panels based on the cells in FIG. 1 therefore are suitable for commercial use.

On the other hand, with the cell 22 according to the invention comprising two rows 24, 26 of resonators $A_1$, $A_2$, $A_3$, $A_4$, an absorption greater than 0.8 is obtained as from 1000 Hz. For higher frequencies, it is found that the coefficient of absorption a increases in order to reach a value of around 1 as from 1500 Hz, the coefficient of absorption then remaining substantially constant and around 1 up to frequencies of 6000 Hz and even beyond (not shown).

These performances are thus obtained for a cell 22 with a much reduced thickness of around 4 cm, which makes it possible to easily integrate it in an acoustic panel without significant losses of space on the ground in the case of integration on walls in a room.

Figure 5:
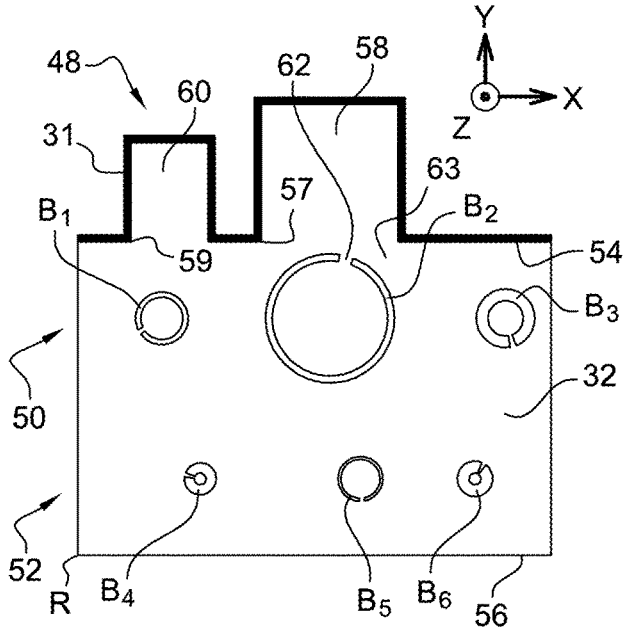
FIG. 5 is a schematic view in cross-section of an acoustically absorbent cell according to a second embodiment of the invention.

FIG. 5 depicts a second embodiment of a cell 48 according to the invention, comprising two rows 50, 52 of three resonators $B_1$, $B_2$, $B_3$ and $B_4$, $B_5$, $B_6$ each. The first face 54 of the cell comprises two cavities 58, 60. Each cavity 58, 60 emerges directly in the direction of a resonator $B_1$, $B_2$, the diameter of which is substantially equal to the dimension of the cavity measured in the direction Y.

Just as with reference to FIG. 3, the opening 62 of the resonator $B_2$ emerges in the direction of the cavity 58 so as to create a resonant assembly (cavity 58 and resonator $B_2$) resonating at a lower frequency than each of the resonator $B_2$ and the cavity 58 in isolation.

In addition to the effect mentioned in the previous paragraph, it is clear that the arrangement of the resonator $B_2$ in the vicinity of the opening of the cavity 58 leads to the formation of two small openings or slots 63. These slots 63 delimit openings similar to those of a Helmholtz resonator, thus enabling the cavity 38 coupled to the openings 63 to absorb at lower frequencies than the quarter-wave frequency of the assembly formed by the cavity 58 and the resonator $B_2$.

The following table summarises the dimensional parameters of the six resonators $B_1$, $B_2$, $B_3$, $B_4$, $B_5$ and $B_6$ and their respective positioning in the cell. The angle values are measured with respect to the direction opposite to the direction of Y given in FIG. 5. The reference for the positions of the centres of the resonators is taken at R in FIG. 5.

In the following table, the values given for each column (except for the third column) are those of a parameter x (without dimension) that constitutes an input value of an equation given in the boxes on the first line in order to deduce therefrom the quantity in the column of interest.

| | External radius (R = x * E/4) | Thickness of the wall (e = 2R * x) | Angular position of the slot | Width of the slot (L = x * R) | Position along the axis X of the centre of the resonator (Px = x * a) | Position along the axis Y of the centre of the resonator (Py = x * E) |
|---|---|---|---|---|---|---|
| Resonator $B_1$ | 0.2 to 0.4 [0.3] | 0.1 to 0.3 [0.13] | 285° to 320° [300] | 0.1 to 0.4 [0.2] | 0.1 to 0.3 [0.17] | 0.6 to 0.9 [0.75] |
| Resonator $B_2$ | 0.5 to 0.8 [0.77] | 0.05 to 0.1 [0.07] | 160° to 300° [165] | 0.1 to 0.4 [0.2] | 0.4 to 0.6 [0.5] | 0.6 to 0.9 [0.75] |
| Resonator $B_3$ | 0.2 to 0.4 [0.3] | 0.2 to 0.5 [0.25] | 0° to 40° [20] | 0.1 to 0.4 [0.2] | 0.7 to 0.9 [0.88] | 0.6 to 0.9 [0.75] |
| Resonator $B_4$ | 0.05 to 0.2 [0.15] | 0.4 to 0.7 [0.6] | 250° to 270° [255] | 0.1 to 0.4 [0.2] | 0.1 to 0.3 [0.27] | 0.2 to 0.4 [0.25] |
| Resonator $B_5$ | 0.1 to 0.3 [0.2] | 0.05 to 0.1 [0.05] | −15° to 15° [0] | 0.1 to 0.4 [0.2] | 0.4 to 0.6 [0.58] | 0.2 to 0.4 [0.25] |
| Resonator $B_6$ | 0.05 to 0.2 [0.16] | 0.4 to 0.7 [0.6] | 110° to 130° [120] | 0.1 to 0.4 [0.2] | 0.7 to 0.9 [0.77] | 0.2 to 0.4 [0.25] |

In each box, the value between brackets indicates a preferred value in the range of values indicated. "E" represents the thickness of the layer of porous material. "a" represents the width of the cell in the direction X (see FIG. 5).

The following table gives the particular values of the cell depicted in FIG. 5 for the values between brackets in the previous table, the value of "E" being 40 mm and the value of "a" being 60 mm.

| | External radius (mm) | Thickness of the wall (mm) | Angular position of the slot (degrees) | Width of the slot (mm) (L = x * R) | Position along the axis X of the centre of the resonator (mm) | Position along the axis Y of the centre of the resonator (mm) |
|---|---|---|---|---|---|---|
| Resonator $B_1$ | 3 | 0.8 | 300 | 0.6 | 10 | 30 |
| Resonator $B_2$ | 7.7 | 1 | 165 | 1.54 | 30 | 30 |
| Resonator $B_3$ | 3 | 1.5 | 20 | 0.6 | 53 | 30 |
| Resonator $B_4$ | 1.5 | 2 | 255 | 0.3 | 16 | 11 |
| Resonator $B_5$ | 2 | 0.2 | 0 | 0.4 | 35 | 11 |
| Resonator $B_6$ | 1.6 | 2 | 120 | 0.32 | 46 | 11 |

The following table summarises the dimensional parameters of the cavities 58, 60 and the positioning of the respective corners 59, 57 of these cavities. In the following table, the values given for each column (with the exception of the values in the columns "along Y", which are in mm) are those of a parameter x (without dimension) that constitutes an input value of an equation given in each column of interest. The values between brackets in each box indicate a preferred value in the range of values indicated.

| | Position of the corner 59 | | Position of the corner 57 | | Dimension of the cavity along the | Dimension of the cavity along the |
|---|---|---|---|---|---|---|
| | Along X (Px = x * a) | Along Y (mm) | Along X (Px = x * a) | Along Y (mm) | axis X (Px = x * a) | axis Y (Py = x * E) |
| Cavity 58 | | | 0.5 to 0.8 [0.57] | E | 0.4 to 0.6 [0.28] | 0.4 to 0.7 [0.5] |

-continued

| | Position of the corner 59 | | Position of the corner 57 | | Dimension of the cavity along the | Dimension of the cavity along the |
|---|---|---|---|---|---|---|
| | Along X (Px = x * a) | Along Y (mm) | Along X (Px = x * a) | Along Y (mm) | axis X (Px = x * a) | axis Y (Py = x * E) |
| Cavity 60 | 0.1 to 0.4 [0.2] | E | | | 0.1 to 0.4 [0.16] | 0.2 to 0.4 [0.35] |

The following table gives the particular values of the cavities 59 and 57 in FIG. 5 for the values between brackets of the previous table, the value of "E" being 40 mm and the value of "a" being 60 mm.

| | Position of the corner 59 (mm) | | Position of the corner 57 (mm) | | Dimension of the cavity along the axis X | Dimension of the cavity along the axis Y |
|---|---|---|---|---|---|---|
| | Along X | Along Y | Along X | Along Y | (mm) | (mm) |
| Cavity 58 | | | 23 | 40 | 17 | 20 |
| Cavity 60 | 8 | 40 | | | 10 | 14 |

Figure 6:
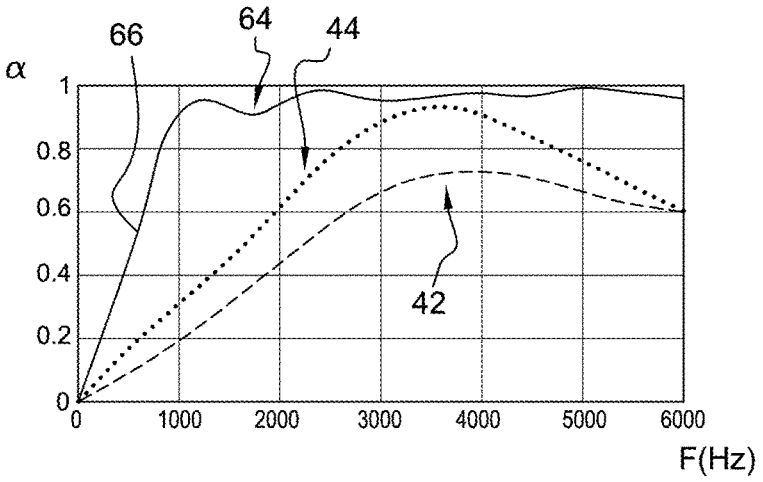
FIG. 6 is a graph showing on the Y axis the coefficient of absorption as a function of the frequency on the X axis for the cell of FIG. 1, the cell of FIG. 5 and the foam alone in which the resonator or resonators are arranged.

The graph in FIG. 6 is a graph similar to the one in FIG. 4. The curve 64 represents the change in the absorption a as a function of frequency and the curves 42 and 44 are identical to those described with reference to FIG. 3.

It is found that the curve 64 comprises a first slope part 66 steeper than with the cell 22 of FIG. 3, demonstrating better absorption. This is because the coefficient of absorption of the cell 48 proves to be slightly greater than almost all the frequency range 0-6000 Hz than the coefficient of absorption of the cell 22.

Figure 7:
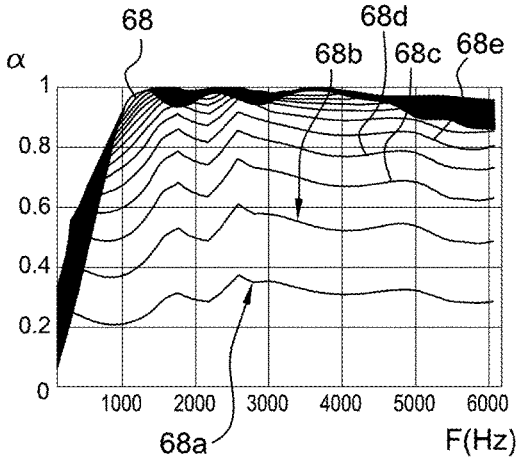
FIG. 7 is a graph showing on the Y axis the coefficient of absorption as a function of the frequency on the X axis for a plurality of values of angles of incidence.

FIG. 7 is a graph showing the change in the absorption on the Y axis as a function of frequency for the cell depicted in FIG. 5. The various curves 68 depicted each correspond to a value of an angle of incidence of acoustic waves on the cell. In particular, the curves 68*a*, 68*b*, 68*c*, 68*d*, 68*e*, . . . correspond to increasing angles and respectively to values of angles of 90°, 85°, 80°, 75° and 70°.

Figure 8:
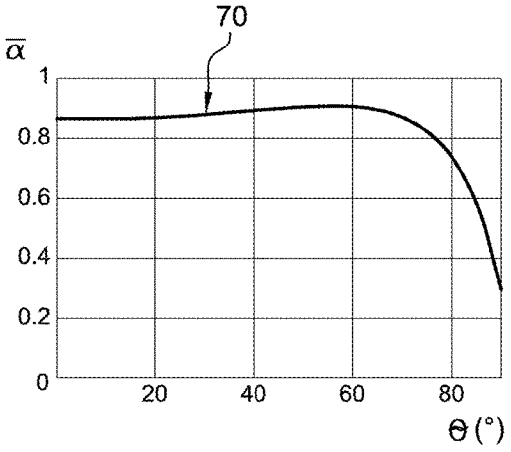
FIG. 8 is a graph showing on the Y axis the average of the coefficients of absorption over the frequency range 100-6000 Hz as a function of the angle of incidence.

The curve 70 in FIG. 8 shows the change in the average absorption over the frequency range 0-6000 Hz as a function of the angle of incidence of acoustic waves on the second face 54 of the cell 48 depicted in FIG. 5. The coefficient of absorption varies very little as a function of the angle of incidence and remains greater than 0.8 for angles of between 0 and 75 degrees. Beyond 75 degrees, that is to say in an incidence considered to be glancing, the coefficient of absorption decreases until it reaches an average of 0.3 at 90 degrees. In the case of glancing incidence, it is probable that the acoustic wave does not enter the cell 48, or only a little, but on the contrary is reflected by the second face and the first row of resonators $B_4$, $B_5$ and $B_6$.

Despite this reduction in the coefficient of absorption at glancing incidence, this material may be considered to be almost omnidirectional and is completely suited to use in diffuse field for example, for buildings acoustics for example. Although not shown, a similar result is obtained for the cell 22 in FIG. 3.

The value "E" of the thickness of the porous material is advantageously between 10 and 80 mm, preferably between 20 and 50 mm and more preferentially is around 40 mm. This is because, for the latter value, it was found that, for all types of cell, such as those described previously, the absorption was between 0.58 and 0.60 on average over the frequency range 125-4000 Hz and around 0.48 over this frequency range for a porous material alone (without resonator) or a cell of FIG. 1.

"a" is advantageously between 1*E and 5*E, or between 10 and 400 mm, preferably between 20 and 160 mm and more preferentially is around 40 mm.

Figure 9:
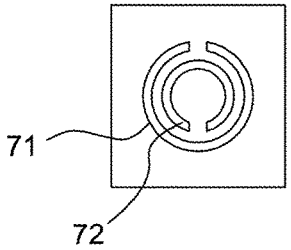
FIG. 9 depicts a schematic view in cross-section of a resonator with two split tubes inserted one inside the other.

Other resonators may also be used instead of the tubes with a circular cross-section, such as split tubes open at their ends and with a square, rectangular, ellipsoidal or star-shaped cross-section. It is also possible to use resonators formed by two split tubes 71, 72 with a cross-section as described previously and inserted one inside the other as depicted in FIG. 9. This type of resonator makes it possible to have no resonant frequencies, but is difficult to implement.

Figure 10A:
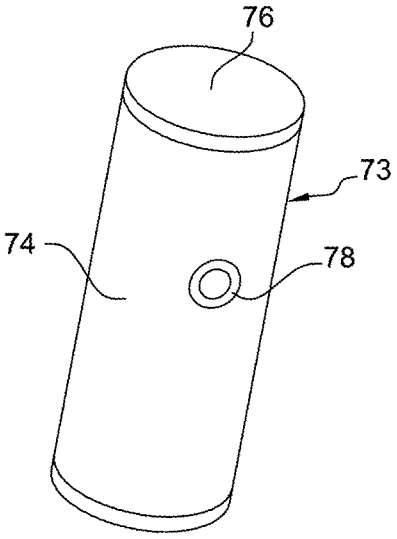
FIG. 10A is a schematic view in perspective of a resonator that can be used in a cell according to the invention.
Figure 10B:
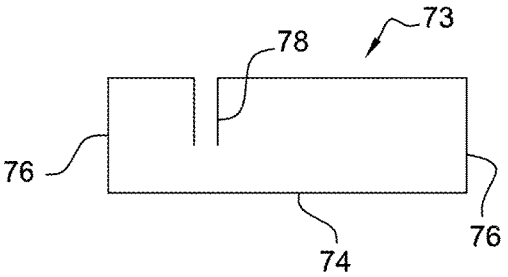
FIG. 10B is a schematic view of FIG. 8A along a cutting plane comprising the direction of elongation of the resonator.

It is also possible to use Helmholtz resonators comprising at least one tubular neck open at both ends and emerging inside a cavity of the resonator. One example of such a resonator 73 is depicted in FIGS. 10A and 10B. This comprises a tubular part 74 closed at its ends by discs 76. This type of so-called Helmholtz resonator is arranged in the same way as the tubes described with reference to FIGS. 3 and 5 with the axis of the tube extending in the direction Z.

Figure 10C:
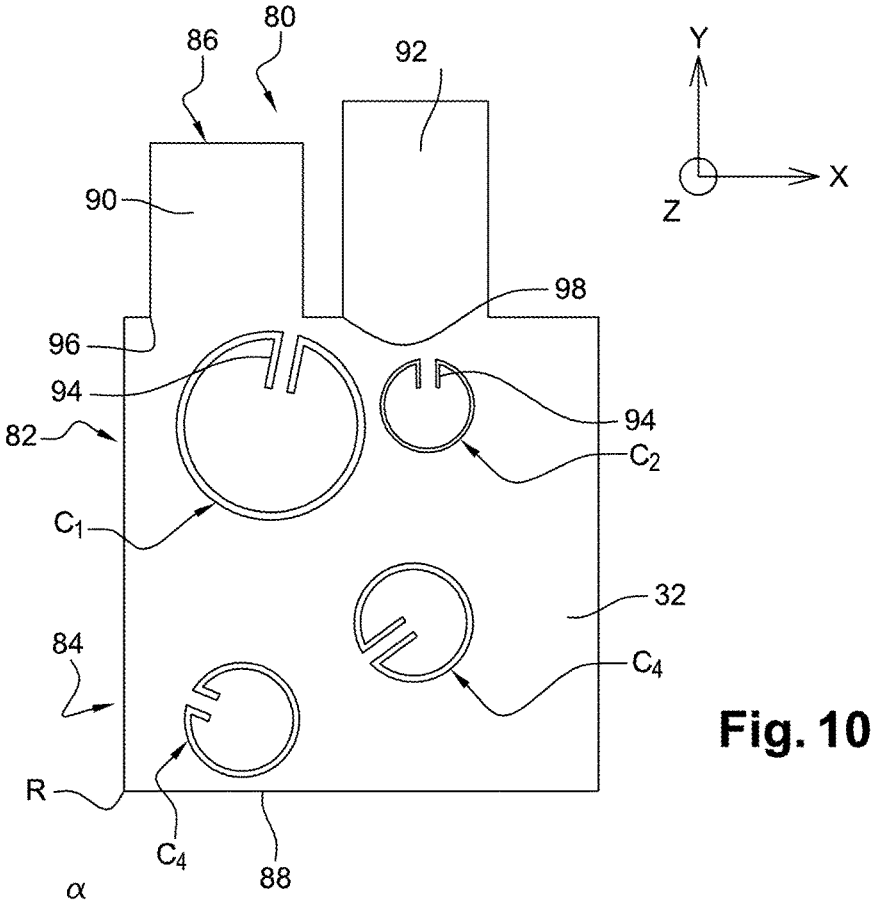
FIG. 10C is a schematic view in cross-section of an absorbent cell according to a third embodiment of the invention.

A practical embodiment of a cell 80 with Helmholtz resonator is depicted in FIG. 10C and comprises two rows 82, 84 of two resonators $C_1$, $C_2$, $C_3$, $C_4$ between a first face 86 and a second face 88. The first face 82 of the cell 80 comprises two cavities 90, 92. The neck 94 of the resonators $C_1$, $C_2$ emerges directly in the direction of a cavity 90, 92 so as to create a resonant assembly (cavity 90 and resonator $C_1$ as well as cavity 92 and resonator $C_2$) resonating at a lower frequency than each of the resonators $C_2$ and the cavities 90, 92 taken in isolation.

The following table summarises the dimensional parameters of the four resonators $C_1$, $C_2$, $C_3$, $C_4$ as well as their respective positionings in the cell 80. The angle values are measured with respect to the direction opposite to the direction of Y. The reference for the positions of the centres of the resonators is taken at R in FIG. 100.

In the following table, the values given for each column (except for the third column) are those of a parameter x (without dimension) that constitutes an input value of an equation given in the boxes on the first line in order to derive therefrom the quantity for the column of interest.

| | External radius (R = x * E/4) | Thickness of the wall (e = 2R * x) | Angular position of the slot | Diameter of neck (d = x * R) | Length of neck (c = x * R) | Position along the axis X of the centre of the resonator (Px = x * a) | Position along the axis Y of the centre of the resonator (Py = x * E) |
|---|---|---|---|---|---|---|---|
| Resonator $C_1$ | 0.6 to 0.9 [0.8] | 0.02 to 0.3 [0.05] | 140° to 200° [165] | 0.05 to 0.2 [0.055] | 0.5 to 1 [0.8] | 0.2 to 0.4 [0.3] | 0.6 to 0.9 [0.75] |
| Resonator $C_2$ | 0.2 to 0.5 [0.4] | 0.02 to 0.3 [0.05] | 160° to 220° [182] | 0.05 to 0.2 [0.12] | 0.3 to 0.7 [0.45] | 0.6 to 0.8 [0.63] | 0.6 to 0.9 [0.8] |
| Resonator $C_3$ | 0.25 to 0.45 [0.48] | 0.02 to 0.3 [0.05] | 230° to 280° [255] | 0.05 to 0.2 [0.1] | 0.2 to 0.6 [0.27] | 0.2 to 0.4 [0.25] | 0.2 to 0.4 [0.25] |
| Resonator $C_4$ | 0.35 to 0.55 [0.5] | 0.02 to 0.3 [0.05] | 275° to 325° [300] | 0.05 to 0.2 [0.1] | 0.7 to 1.1 [0.8] | 0.6 to 0.8 [0.6] | 0.2 to 0.4 [0.35] |

In each box, the value between brackets indicates a preferred value in the range of values indicated. "E" represents the thickness of the layer of porous material. "a" represents the width of the cell in the direction X (see FIG. 10C).

The following table gives the particular values of the cell depicted in FIG. 10C for the values between brackets in the previous table, the value of "E" being 40 mm and the value of "a" being 40 mm.

| | External radius (mm) | Thickness of the wall (mm) | Angular position of the slot (degrees) | Diameter of neck (mm) | Length of neck (mm) | Position along the axis X of the centre of the resonator (mm) | Position along the axis Y of the centre of the resonator (mm) |
|---|---|---|---|---|---|---|---|
| Resonator $C_1$ | 8 | 0.8 | 165° | 0.44 | 6.5 | 12 | 30 |
| Resonator $C_2$ | 4 | 0.4 | 182° | 0.48 | 1.8 | 25 | 32 |
| Resonator $C_3$ | 4.8 | 0.48 | 255° | 0.46 | 1.3 | 10 | 10 |
| Resonator $C_4$ | 5 | 0.5 | 300° | 0.48 | 4 | 24 | 14 |

The following table summarises the dimensional parameters of the cavities 90, 92 and the positioning of the respective corners 96, 90 of the cavities 90, 92. In the following table, the values given for each column (with the exception of the values of the columns "along Y", which are in mm) are those of a parameter x (without dimension) that constitutes an input value of an equation given in each column of interest. The values between brackets in each box indicate a preferred value in the range of values indicated.

| | Position of the corner 96 | | Position of the corner 98 | | Dimension of the cavity along the | Dimension of the cavity along the |
|---|---|---|---|---|---|---|
| | Along X (Px = x * a) | Along Y (mm) | Along X (Px = x * a) | Along Y (mm) | axis X (Px = x * E) | axis Y (Py = x * E) |
| Cavity 92 | | | 0.3 to 0.7 [0.45] | E | 0.2 to 0.4 [0.3] | 0.4 to 0.6 [0.45] |
| Cavity 90 | 0.05 to 0.2 [0.075] | E | | | 0.1 to 0.3 [0.3] | 0.2 to 0.5 [0.38] |

The following table gives the particular values of the cavities 90, 92 of FIG. 10C for the values between brackets in the previous table, the value of "E" being 40 mm and the value of "a" being 40 mm.

| | Position of the corner 96 (mm) | | Position of the corner 98 (mm) | | Dimension of the cavity along the | Dimension of the cavity along the |
|---|---|---|---|---|---|---|
| | Along X | Along Y | Along X | Along Y | axis X (Px = x * E) | axis Y (Py = x * E) |
| Cavity 92 | | | 18 | 40 | 12 | 18 |
| Cavity 90 | 3 | 40 | | | 12 | 15 |

Figure 10D:
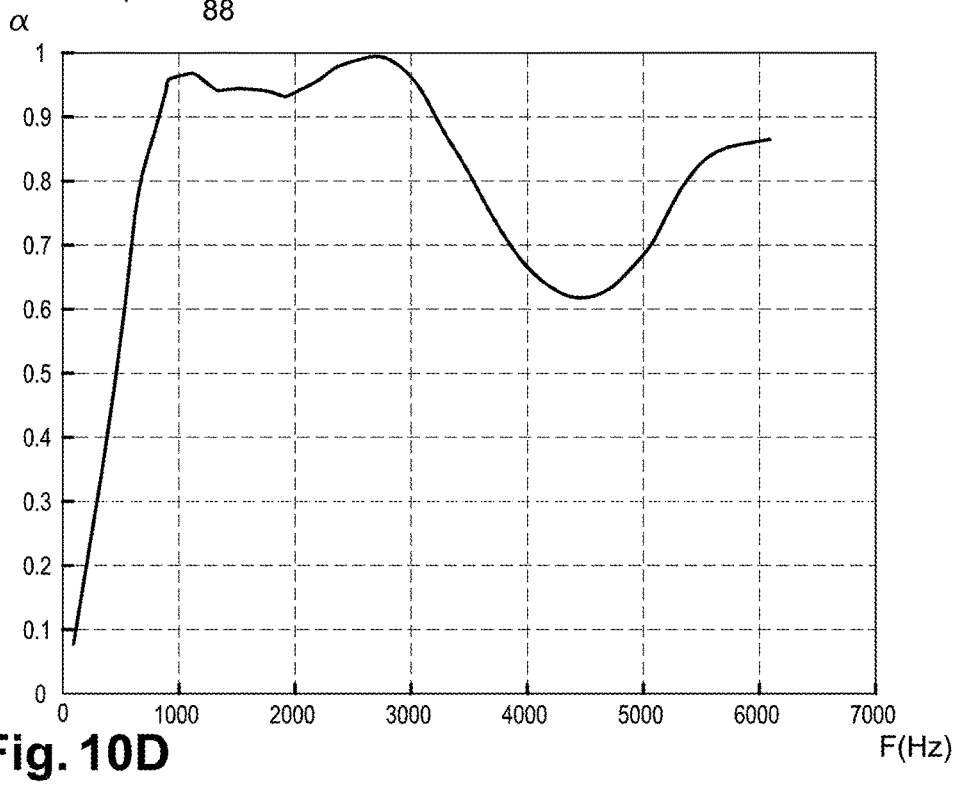
FIG. 10D is a graph showing on the Y axis the coefficient of absorption as a function of the frequency of the X axis for the cell of FIG. 10C.

FIG. 10D shows the change in the absorption a (without unit) on the Y-axis as a function of the frequency (in Hz) on the X-axis. It can be seen that the absorption is greater than 0.9 as from approximately 850 Hz and up to 3000 Hz, the absorption being even greater than that obtained with the cells in FIGS. 3 and 5 over this range of frequencies. However, it is noted that, beyond 3000 Hz, the absorption drops fairly sharply.

Figure 11:
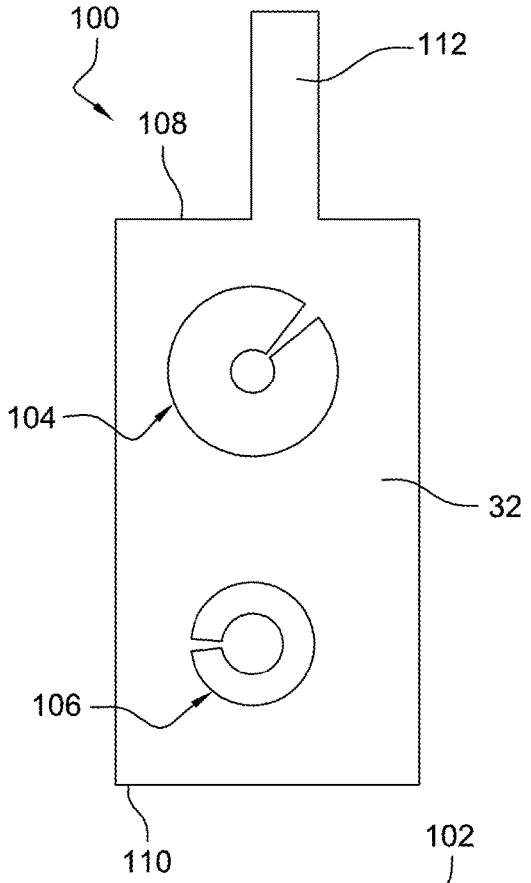
FIGS. 11 and 12 are schematic views in cross-section of two absorbent cells according to fourth and fifth embodiments of the invention.
Figure 12:
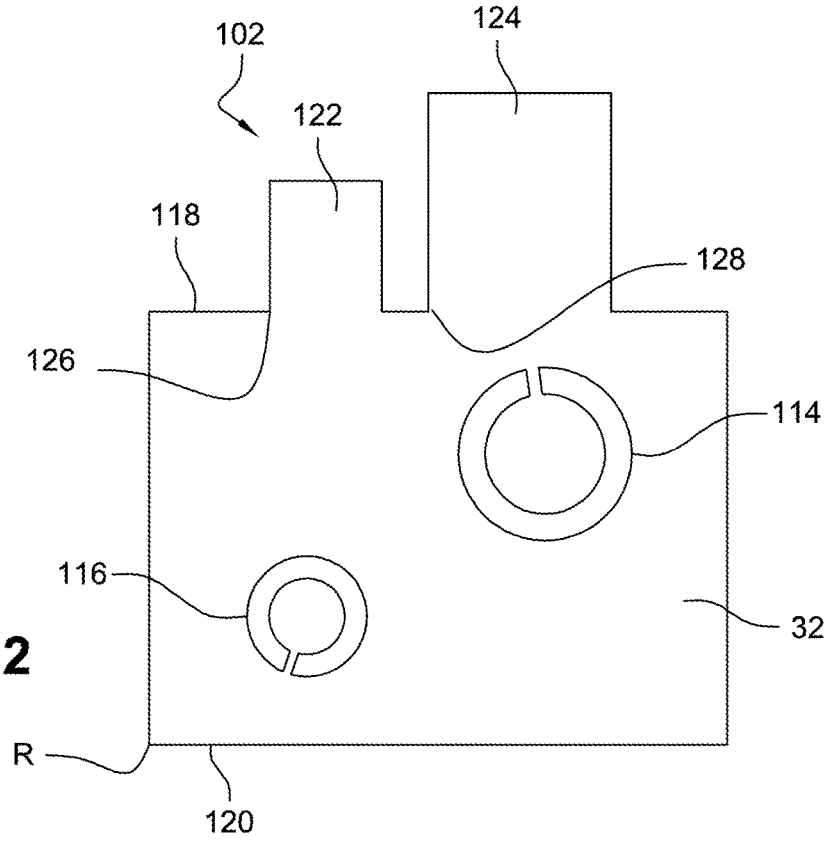

FIGS. 11 and 12 show other embodiments of the invention in which the cell 100, 102 comprises only two acoustic resonators, which are here split tubes.

In the embodiment in FIG. 11, two resonators 104, 106 are arranged one behind the other in a direction (Y-axis) perpendicular to the first 108 and second 110 faces of the cell 100. A cavity 112 formed on the first face 108 of the cell 100.

In the embodiment in FIG. 12, a first resonator 114 is arranged, in a direction (Y-axis) perpendicular to the first face 118 and to the second face 120, between a second resonator 116 and the first face 118 of the cell, the second resonator 116 being arranged between the first resonator 114 and the second face 120 of the cell 102. The first face 118 of the cell 102 comprises two cavities 122, 124. Unlike FIG. 11, the first resonator 114 is offset along the X-axis with respect to the second resonator 116. In addition, each of the first 114 and second 116 resonators is aligned in a direction parallel to the Y-axis with a cavity of the first face. The slot or opening of the first resonator 114 emerges in the direction of the cavity 124.

The following table summarises the dimensional parameters of the two resonators $D_1$, $D_2$ as well as their respective positionings in the cell in FIG. 12. The angle values are measured with respect to the direction opposite to the positive direction of Y. The reference for the positions of the centres of the resonators is taken at R in FIG. 12.

In the following table, the values given for each column (except for the third column) are those of a parameter x (without dimension) which constitutes an input value of an equation given in the boxes on the first line in order to deduce therefrom the quantity in the column of interest.

| | External radius (R = x * E/4) | Thickness of the wall (e = 2R * x) | Angular position of the slot | Width of the slot (d = x * R) | Position along the axis X of the centre of the resonator (Px = x * a) | Position along the axis Y of the centre of the resonator (Py = x * E) |
|---|---|---|---|---|---|---|
| Resonator D1 | 0.4 to 0.6 [0.53] | 0.1 to 0.3 [0.22] | −40 to 0 [-25] | 0.05 to 0.2 [0.15] | 0.2 to 0.4 [0.27] | 0.1 to 0.4 [0.3] |
| Resonator D2 | 0.6 to 0.9 [0.8] | 0.1 to 0.3 [0.23] | 180 to 210 [195] | 0.05 to 0.2 [0.13] | 0.6 to 0.8 [0.67] | 0.6 to 0.9 [0.66] |

In each box, the value between brackets indicates a preferred value of the range of values indicated. "E" represents the thickness of the layer of porous material. "a" represents the width of the cell in the direction X (see FIG. 12).

The following table gives the particular values of the cell depicted in FIG. 12 for the values between brackets in the previous table, the value of "E" being 30 mm and the value of "a" being 40 mm.

| | External radius (mm) | Thickness of the wall (mm) | Angular position of the slot (degrees) | Width of the slot (mm) | Position along the axis X of the centre of the resonator (mm) | Position along the axis Y of the centre of the resonator (mm) |
|---|---|---|---|---|---|---|
| Resonator D1 | 4 | 1.6 | −25° | 0.6 | 11 | 9 |
| Resonator D2 | 6 | 1.8 | 195° | 0.8 | 27 | 20 |

The following table summarises the dimensional parameters of the cavities 124, 122 and the positioning of the respective corners 126, 128 of these cavities. In the following table, the values given for each column (with the exception of the values in the columns "along Y", which are in mm) are those of a parameter x (without dimension) that constitutes an input value of an equation given in each column of interest. The values between brackets in each box indicate a preferred value in the range of values indicated.

| | Position of the corner 126 | | Position of the corner 128 | | Dimension of the cavity along the | Dimension of the cavity along the |
|---|---|---|---|---|---|---|
| | Along X (Px = x * a) | Along Y (mm) | Along X (Px = x * a) | Along Y (mm) | axis X (Px = x * E) | axis Y (Py = x * E) |
| Cavity 124 | | | 0.6 to 0.8 [0.47] | E | 0.2 to 0.4 [0.3] | 0.4 to 0.6 [0.5] |
| Cavity 122 | 0.2 to 0.4 [0.22] | E | | | 0.1 to 0.3 [0.19] | 0.2 to 0.5 [0.29] |

The following table gives the particular values of the cavities 122, 124 in FIG. 12 for the values between brackets in the previous table, the value of "E" being 30 mm and the value of "a" being 40 mm.

| | Position of the corner 126 (mm) | | Position of the corner 128 (mm) | | Dimension of the cavity along the axis X (Px = | Dimension of the cavity along the axis Y (Py = |
|---|---|---|---|---|---|---|
| | Along X | Along Y | Along X | Along Y | x * E) | x * E) |
| Cavity 124 | | | 19 | 40 | 12 | 15 |
| Cavity 122 | 9 | 30 | | | 7.5 | 8.7 |

The use of the resonators $A_1$-$A_4$, $B_1$-$B_6$, C1-C4, D1-D2, all different in pairs to their dimensional parameters as depicted and described with reference to FIGS. 3 and 5, makes it possible to ensure absorption of each resonator at a different resonant frequency, which makes it possible to ensure absorption of a wide range of frequencies. For this purpose, it is desirable for these various resonant frequencies to be sufficiently close to one another.

Figure 13:
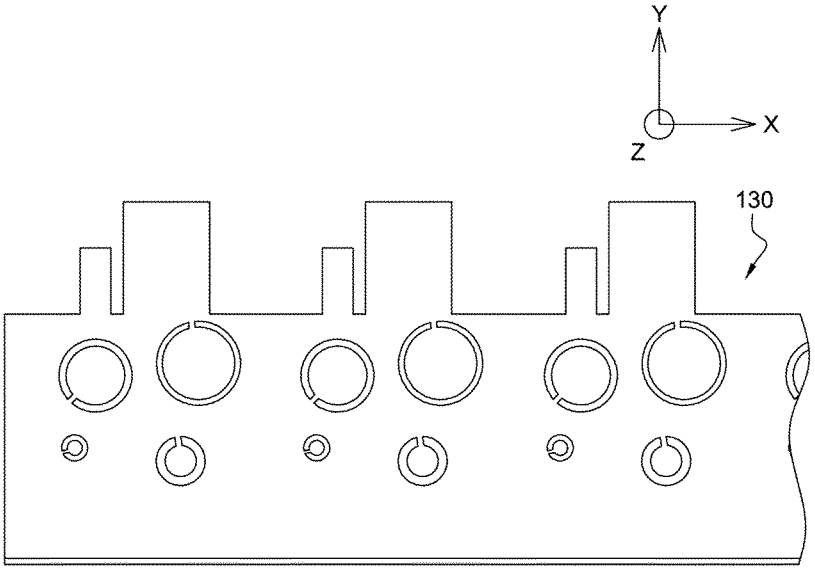
FIG. 13 is a view in cross-section of an acoustic panel according to the invention.
Figure 14:
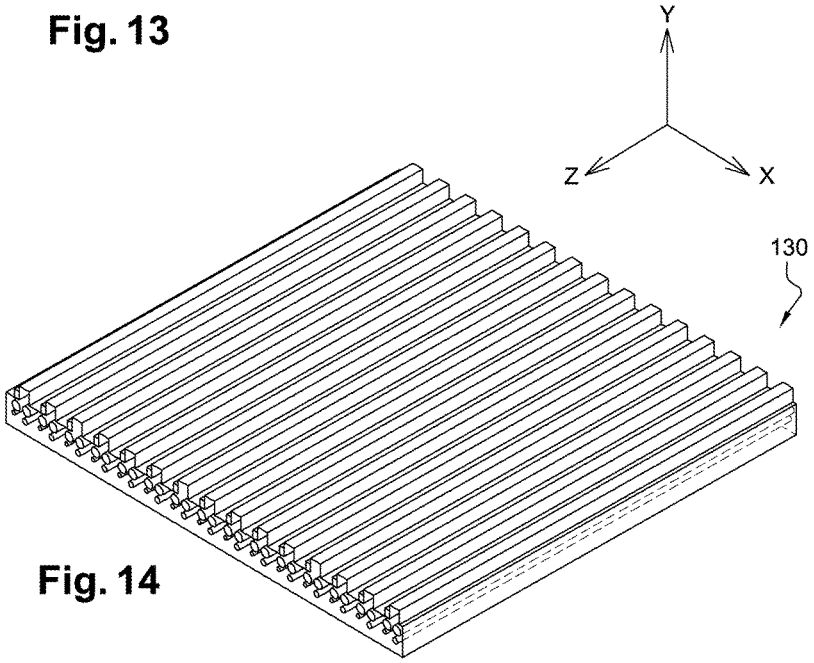
FIG. 14 is a schematic view in perspective of the acoustic panel of FIG. 13.

In a practical use of the cells of FIGS. 3, 5, 10C, 11 and 12 in an acoustically absorbent panel, the cells 22, 48 are arranged alongside each other so that the edges of the first faces 50, 54 of the cells are arranged facing each other and the edges of the second faces 28, 56 of the cells are arranged facing each other. FIGS. 13 and 14 depict such an acoustic panel 130 with a cell similar to that of FIG. 3, which comprises two rows of two acoustic resonators each. However, in the example in FIGS. 13 and 14, the cell comprises two cavities at its first face.

The acoustic panel thus obtained thus comprises a plurality of juxtaposed cells, for example five and preferably ten, which makes it possible to obtain the best absorption results for the various types of cell. It would also be possible to add a second thickness of cells, which would improve the absorption performances, mainly in the range 500-4000 Hz. However this requires a doubling of the thickness of the acoustic panel and this type of configuration therefore has to be reserved for specific applications, such as recording studios for example.

In the description, the term "porous matrix" designates a material with a rigid skeleton saturated with a fluid, which may be air in the case of an application in buildings. Preferentially, the saturation ratio, that is to say the ratio of the volume of fluid to the volume of liquid, must be at least 80%.

The porous matrix 32 may be formed from at least one of the following materials: melamine, polyurethane foam, glass wool, rock wool, straw, hemp, cellulose fibre, palm fibre, and coconut fibre.

The resonators $A_1$-$A_4$, $B_1$-$B_6$, C1-C4, D1-D2 may be produced from steel, plastics material, rubber or bamboo. Hollow reeds may also be used.

It should also be noted that the cavities of the cells 22, 48, 80, 100, 102 may either be filled with the same material as the rest of the porous layer or be filled with another porous material. Likewise, the cavities 38, 58, 60, 90, 92, 112, 122, 124 of the resonators 22, 48, 80, 100, 102 may be filled with the same porous material as that of the porous layer or be filled with a different porous material.

The cells 22, 48, 80, 100, 102 according to the invention are produced in two steps. The first consists of producing, in a block of porous material, a plurality of orifices, the cross-sections of which correspond to the cross-sections of the resonators, by means of a suitable cutting tool, for example mounted on a pillar drilling machine, and sampling the cores of porous material thus obtained. The resonators are next introduced into the corresponding orifices. The block of porous material is next cut to the required size of the cell by means for example of a handsaw or by water-jet cutting.

In the case where the cell 22, 48, 10C comprises at least a first and a second row of resonators each comprising at least two resonators as in the embodiments in FIGS. 3, 5 and 10C, it will be understood that the invention may be defined as an acoustically absorbent cell for an acoustic panel, comprising a layer with a porous matrix incorporating a plurality of acoustic resonators (A1-A4, B1-B6) between a first face 30, 54, 86 and a second face 28, 56, 88 of the porous matrix 32, characterised in that the resonators $A_1$-$A_4$, $B_1$-$B_6$, C1-C4 are ordered so as to form at least two substantially parallel rows each comprising at least two resonators and extending along the first and second faces. Thus a first row 24, 50, 82 is arranged between the first face 30, 54, 86 and at least two second resonators forming a second row 26, 52, 88 that is arranged between the first row 24, 50, 82 of resonators and the second face 28, 56, 88.

The invention may also relate to an acoustically absorbent cell comprising a layer with a porous matrix incorporating a plurality of acoustic resonators between a first face and a second face of the porous matrix, the dimensional characteristics of the resonators being determined so that the resonators are all different in pairs.

The invention may also relate to an acoustically absorbent cell comprising a layer with a porous matrix incorporating a plurality of acoustic resonators between a first face and a second face of the porous matrix, the first face being conformed so as to comprise at least one indentation forming a cavity extending in a direction opposite to the second face and emerging between the two first and second faces.

The invention claimed is:

1. An acoustically absorbent cell for an acoustic panel, comprising a layer with a porous matrix incorporating a plurality of acoustic resonators between a first face and a second face of the porous matrix, wherein the resonators are ordered so that, in a direction extending substantially perpendicular to the first face and the second face, at least one first resonator is arranged between the first face and a second resonator, and at least one second resonator is arranged between the second face and the at least one first resonator.

2. The cell according to claim 1, wherein the dimensional characteristics of the resonators are determined so that the resonators are all different.

3. The cell according to claim 1, wherein the distances separating two resonators are all different.

4. The cell according to claim 1, wherein the first face comprises a layer of a rigid material having a Young's modulus of at least 20 GPa.

5. The cell according to claim 1, wherein the first face is conformed so as to comprise at least one indentation forming a cavity extending in a direction opposite to the second face and emerging between the first and second faces.

6. The cell according to claim 5, wherein the cavity or cavities has or have a rectangular or square cross-section.

7. The cell according to claim 1, wherein the resonators each comprise at least one opening making a resonant cavity of the resonator communicate with the porous matrix surrounding the resonator.

8. The cell according to claim 7, wherein the opening of at least one of said at least one first resonator emerges in the opening of a cavity of the first face.

9. The cell according to claim 1, wherein the resonators each have an elongate shape in a given direction extending along the first and second faces of the cell.

10. The cell according to claim 9, wherein the directions of elongation of the resonators are substantially parallel to one another.

11. The cell according to claim 1, wherein the resonators are chosen from one or more of the types of resonator in the group comprising split tubes open at their ends and with square, rectangular, circular, ellipsoidal or star-shaped cross-section, Helmholtz resonators comprising at least one tubular neck emerging inside a cavity of the resonator.

12. The cell according to claim 11, wherein the resonators are all of the same type.

13. The cell according to claim 11, wherein the resonators are all tubes with a circular cross-section, split over their entire height.

14. The cell according to claim 1, wherein it comprises at least two first resonators forming a first row arranged between the first face and two second resonators, and at least two second resonators forming a second row that is arranged between the first row of resonators and the second face.

15. The cell according to claim 14, wherein the first row and the second row each comprise at least three resonators.

16. The cell according to claim 1, wherein the second face is substantially flat.

17. An acoustically absorbent panel, wherein it comprises a plurality of cells according to claim 1, the cells being arranged alongside one another so that the edges of the first faces of the cells are arranged facing each other and the edges of the second faces of the cells are arranged facing each other.

18. The panel according to claim 17, wherein it comprises at least ten cells.

* * * * *